US005726425A

United States Patent [19]

Moebius

[11] Patent Number: 5,726,425

[45] Date of Patent: Mar. 10, 1998

[54] TUBULAR HEATING ELEMENT WITH ELASTIC ELECTRODE

[75] Inventor: Heinz-Guenter Moebius, Duisburg, Germany

[73] Assignee: Minnesota Mining and Manufacturing Company, St. Paul, Minn.

[21] Appl. No.: 426,962

[22] Filed: Apr. 24, 1995

[30] Foreign Application Priority Data

Jun. 9, 1994 [DE] Germany ..... 44 20 094.3

[51] Int. Cl.[6] ..... H05B 3/26

[52] U.S. Cl. ..... 219/471; 219/469

[58] Field of Search ..... 219/216, 244, 219/469, 471, 541, 543; 338/316; 439/21, 25, 29, 788, 799, 840

[56] References Cited

U.S. PATENT DOCUMENTS

| | | | |
|---|---|---|---|
| 1,668,381 | 5/1928 | Schild | 439/840 |
| 3,056,101 | 9/1962 | Bethke | 439/21 |
| 3,401,439 | 9/1968 | Staats et al. | 219/244 |
| 3,612,170 | 10/1971 | Juppet et al. . | |
| 4,033,654 | 7/1977 | Ross | 439/840 |
| 4,570,055 | 2/1986 | McMills | 219/541 |
| 4,801,968 | 1/1989 | Kogure et al. | 219/216 |
| 4,820,904 | 4/1989 | Urban | 219/216 |
| 5,191,381 | 3/1993 | Yuan . | |
| 5,532,807 | 7/1996 | Takemoto | 219/471 |

FOREIGN PATENT DOCUMENTS

| | | |
|---|---|---|
| 0 241 714 A1 | 10/1987 | European Pat. Off. . |
| 0 470 554 A1 | 12/1992 | European Pat. Off. . |
| 2337751-B | 2/1975 | Germany . |
| 3021 737 C2 | 11/1983 | Germany . |
| 38 19 698 A1 | 12/1988 | Germany . |
| 470554-A | 5/1991 | Germany . |
| 4-213480 | 8/1992 | Japan . |
| 035137 | 2/1993 | Japan . |

*Primary Examiner*—Teresa J. Walberg
*Assistant Examiner*—Gregory L. Mills
*Attorney, Agent, or Firm*—Carolyn A. Bates; Kent J. Sieffert

[57] ABSTRACT

A heating element having an electrically heatable layer comprises a support tube (16) provided with an electrically resistive heating layer (14), and electrodes for applying a voltage to the resistive heating layer (14). At least one electrode is provided as an elastic electrode, having a contacting side for engaging the resistive heating layer (14) and being adapted for arrangement on the support tube (16), with the contacting side of the electrode abutting the resistive heating layer (14). The contacting side has free ends comprising a plurality of projections having abutment faces, abutment lines or abutment points for contacting the resistive heating layer (14).

10 Claims, 3 Drawing Sheets

3.4

TUBULAR HEATING ELEMENT WITH ELASTIC ELECTRODE

BACKGROUND OF THE INVENTION

1. Field of the Invention

The invention is directed to a heating element comprising an electrically heatable layer, a support tube with an electrically resistive heating layer, and electrodes for applying a voltage to the resistive heating layer.

2. Background of the Invention

Heating elements, particularly heated rollers, are used in a wide variety of heat treatment devices. In particular, heated rollers having a heatable peripheral surface are used in heat fixing stations in copying machines to fix the toner image and as laminating rollers in color proofing systems to laminate a colorant layer comprising a visible light absorbing composition and particularly color particles, onto a carrier, i.e. the proof. Examples of heated rollers are found, inter alia, in U.S. Pat. No. 4,820,904, DE-B-23 37 751, U.S. Pat. No. 5,191,381, EP-A-0 470 554, JP-A-5-35137 and JP-A-4-213480.

Known heating elements are provided with a support tube having an electrically resistive heating layer applied thereon. The resistive heating layer is in contact with electrodes which are connected, via conductors, to an electric energy source. To provide uniform heating of the resistive heating layer, it is required that the electrodes are in uniform electrical and mechanical contact with the resistive heating layer. Known heating elements are provided with relatively complicated mechanisms for contacting the electrodes with the resistive heating layer, causing increased production costs for the heating element.

SUMMARY OF THE INVENTION

A heating element having an electrically heatable layer, comprising a support tube (16) provided with an electrically resistive heating layer (14), and electrodes for applying a voltage to the resistive heating layer (14), characterized in that at least one electrode is provided as an elastic electrode, having a contacting side for engaging the resistive heating layer (14) and being adapted to be arranged on the support tube (16) with the contacting side of the electrode engaging the resistive heating layer (14), that a device is provided for holding the contacting side of said at least one electrode in engaging contact and electrical contact with the resistive heating layer (14), and that the contacting side is provided with a plurality of projections having abutment faces, abutment lines or abutment points for contacting the resistive heating layer (14).

One aspect of the invention is to provide a heating element having an electrically heatable layer wherein a reliable and uniform contact between the electrodes and the resistive heating layer is realized by simple means.

DETAILED DESCRIPTION OF THE INVENTION

Figure 1:
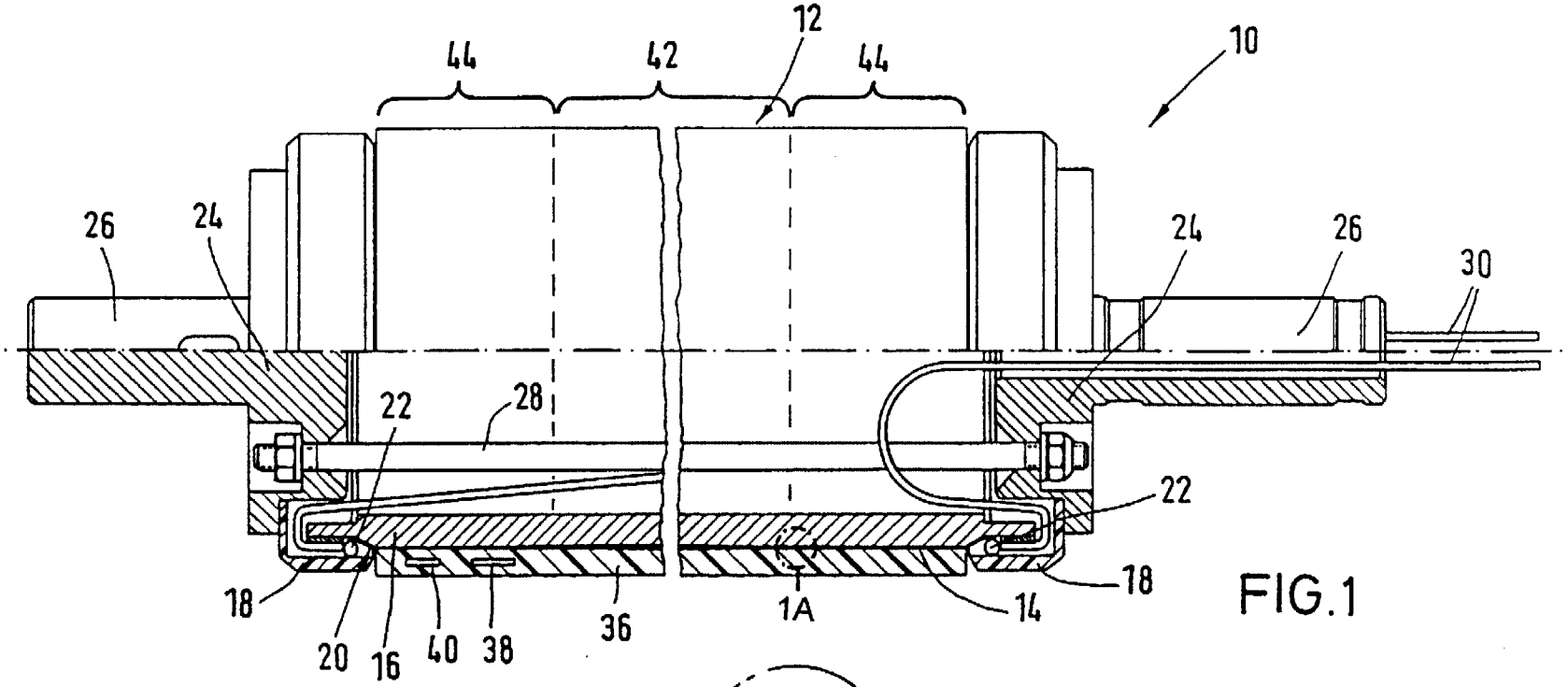
FIG. 1 is a lengthened section of a heated roller 10 of the invention.

According to the invention, there is provided a heating element with an electrically heatable layer, comprising a support tube with an electrically resistive heating layer formed thereon, and electrodes for applying a voltage to the resistive heating layer, wherein at least one electrode is an elastic electrode and has a contacting side for abutting the resistive heating layer. The electrode can be arranged on the support tube with the contacting side of the electrode abutting the resistive heating layer and with the contacting side of said at least one electrode being maintained in electrical contact and in abutting contact or abutting engagement with the resistive heating layer by use of a suitable device. The contacting side has free ends which are provided with a plurality of projections having abutment faces, abutment lines or abutment points formed thereon for contacting the resistive heating layer.

According to the invention, a heating element is described wherein at least one electrode and preferably both electrodes have an uneven contacting face with a plurality of individual projections formed thereon. Preferably, these projections are arranged closely adjacent each other. The free ends of the projections are formed as abutment faces, abutment lines or abutment points for contacting the resistive heating layer. When the electrode has been arranged on the resistive heating layer and/or the support tube, the abutment faces, abutment lines or abutment points provided on the free ends of the projections are in contact with the resistive heating layer. Because of the elasticity of the electrode, the electrode will adapt itself to the structure of the resistive heating layer, e.g., to a curved structure as is the case in heated rollers. Therefore, according to the invention, it is not required that the overall structure of the electrode is specially adapted to the form of the support tube or the resistive heating layer; instead, there is used an elastic electrode which is not in full-surface contact with the resistive heating layer but is in point contact or linear contact with it. A device is provided for maintaining the contact of the abutment faces, abutment lines or abutment points on the resistive heating layer. This device can maintain the contact, e.g., as a pressure means or by the effect of gluing. The projections, preferably distributed over the contacting face substantially equally, provide for substantially uniform contacting between the electrode and the resistive heating layer over the whole contacting region. This permits substantially uniform supply of electric current to the resistive heating layer so that the resistive heating layer, when viewed over its two-dimensional expansion, is heated with substantially uniform intensity.

According to a preferred embodiment of the invention, a heating element is described wherein said at least one electrode is formed as a band provided with protrusions. Particularly, the elastic electrode band is a material strip of zig-zag-shaped or wave-shaped longitudinal section. Such a zig-zag-shaped or wave-shaped band is both elastic and flexible and thus, while being widened in the axial direction, can be laid around the circumferential face of a support tube or a similar support body provided with a resistive heating layer.

The elasticity of said at least one electrode is advantageous because of the resultant pressing force which presses the abutment faces, abutment lines or abutment points of the electrode projections to the resistive heating layer when the electrode is tensioned in the direction of its elasticity. Thus, the elasticity is to be considered as a means for maintaining the contact between the contacting side and the resistive heating layer.

According to a further preferred embodiment of the invention, a heating element is described wherein said at least one electrode is formed as a closed electrode ring which is elastic in the circumferential direction and can be laid around the support tube while being elastically widened and being in contact with the resistive heating layer. Annular electrodes of this configuration are particularly useful if the heating body is a heated roller having the resistive heating layer provided on its circumferential surface. The electrode ring, which in its normal condition has a smaller diameter than the support tube including the resistive heating layer, is placed onto the resistive heating layer and, because of the resultant elastic restoring force, will then press radially inwardly against the resistive heating layer.

In a particularly simple arrangement, said at least one electrode can be provided as a spiral tension spring ring. This spiral tension spring is wound as closely as possible for providing the largest possible number of evenly distributed points or lines of contact with the resistive heating layer. With each turn of the spiral tension spring, one contact point with the resistive heating layer is obtained. When realizing the presently described elastic and flexible electrode, use can be made of standard components, i.e. a spiral tension spring made from electrically conductive material of preferably low ohmic resistance. By suitable selection of the diameter of the spiral tension spring ring in relation to the diameter of the support tube, it is possible to set the force with which the spiral tension spring presses on the resistive heating layer.

Preferably, to achieve a uniform supply of electric current to the electrode over the complete length of the electrode, a plurality of electric supply conductors (e.g., wires) to the electrode are provided.

Preferably, to fix the elastic and flexible electrode on the cylindrical resistive heating layer in axial direction and to provide some wear protection for the electrode, a continuous peripheral groove is formed in the resistive heating layer, or the carrier layer has a continuous peripheral groove formed therein which, like the remaining peripheral face of the support tube, is also provided with the resistive heating layer. The electrode can be placed in this peripheral groove and thus is secured against undesired axial displacement.

Alternatively, the mechanical fixing of the elastic and flexible electrode on the resistive heating layer can be obtained by providing the axial ends of the support tube with conically tapering portions and by having the electrode abut the resistive heating layer in this region of the resistive heating layer. For this purpose, there may be used a substantially rotationally symmetric holding element having an axially projecting continuous edge portion for gripping from outside around the axial ends of the support tube up to the conical portions thereof. The elastic electrode is kept in pressing contact with the conical portion between the continuous edge of the holding element and the support tube.

The resistive heating layer is preferably made from a ceramic material of a surface resistance which permits the use of the ceramic material as a heating element. Ceramic materials of this type are generally available and are described, for instance, in some of the initially mentioned patent publications relating to heated rollers.

Preferably, an electrical insulation layer is arranged between the resistive heating layer and the support tube. Preferably, an outer layer of a silicone rubber material is arranged around the outer side of the resistive heating layer. If desired, a still further insulating layer can be arranged between the resistive heating layer and the silicone rubber outer layer. In such an arrangement, each insulating layer can likewise comprise a ceramic material which in this case is electrically insulating. Between the resistive heating layer and the outer layer, one or a plurality of sensors or the like can be provided, if desired.

To provide a uniform temperature in the region between the two electrodes, it is preferred that the resistive heating layer has a—preferably gradually—varying thickness because, in the region of the mutually opposite ends of the support tube where the electrodes are arranged, the heat dissipation into the environment is larger than in the central region between the two electrodes. To compensate for this effect, the heating temperature in the regions of the heating layer near the electrodes is selected to be higher than in the central region. This in turn is realized in that the thickness of the central regions of the resistive heating layer is larger than in the edge regions thereof so that the current density, i.e. the current intensity per cross-sectional unit of the resistive heating layer, is larger in the edge regions than in the central region.

Embodiments of the invention will be explained in greater detail hereunder with reference to the accompanying drawings.

Figure 3:
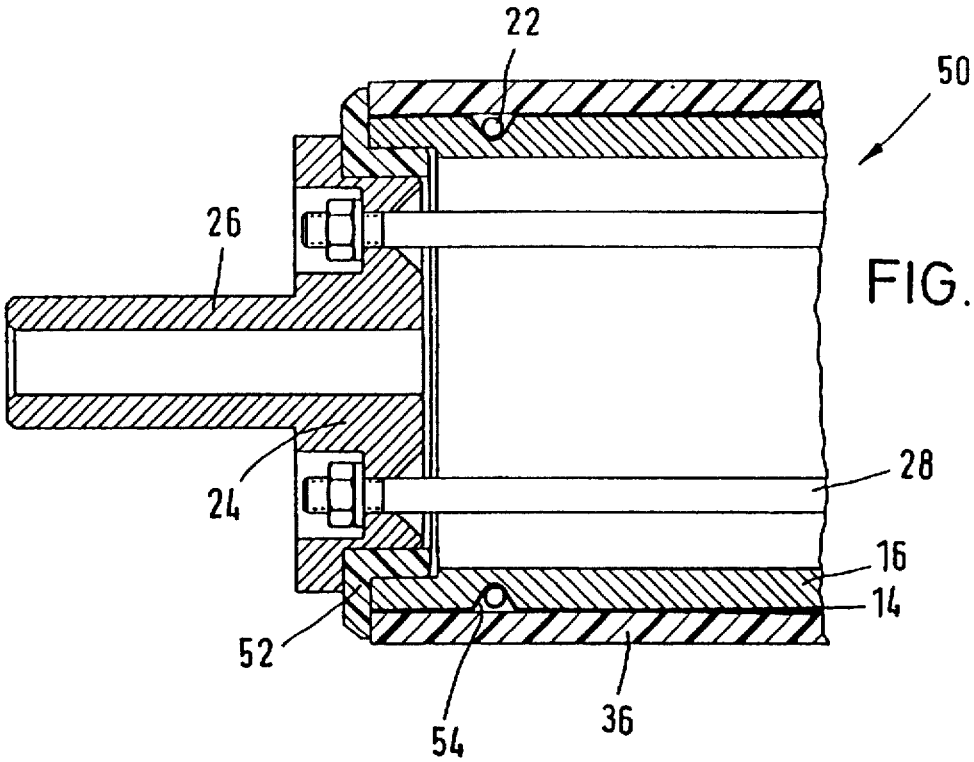
FIG. 3 shows a longitudinal cross-section of a heated roller 50 according to another aspect of the invention.
Figure 2:
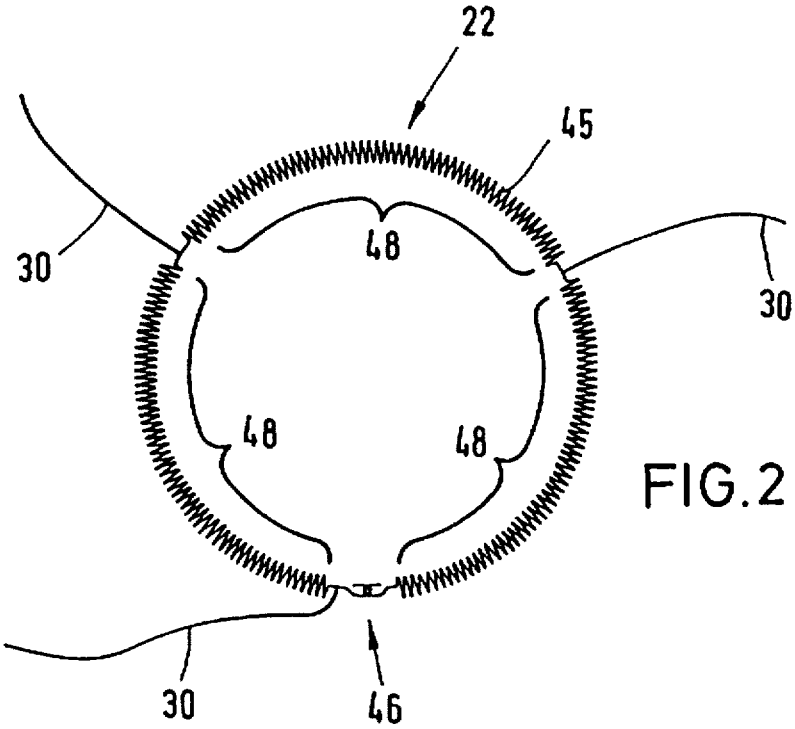
FIG. 2 is a cross-section of a heating element 10 of the invention perpendicular to a long axis.
Figure 4:
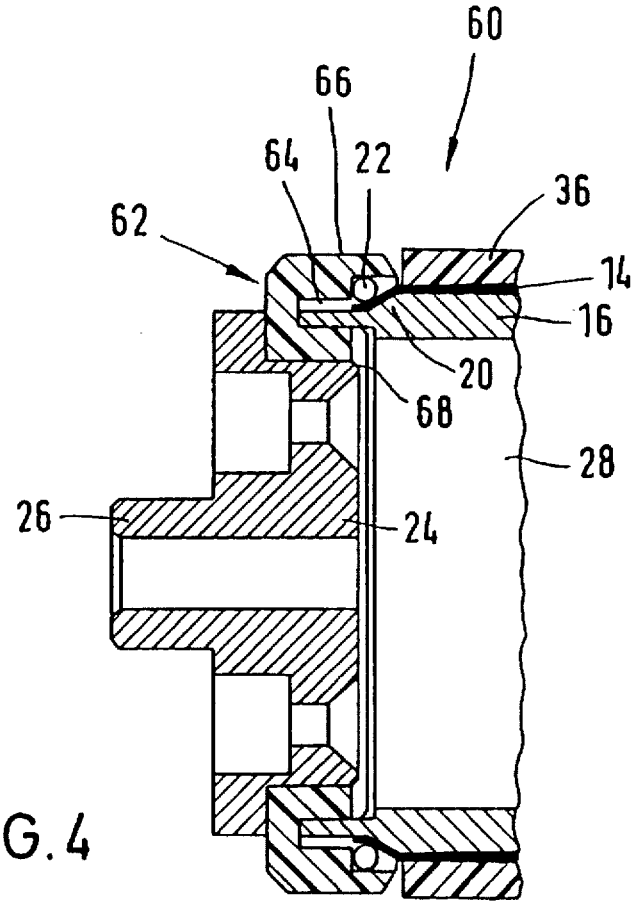
FIG. 4 shows a longitudinal cross-section of a heated roller 60 according to a third embodiment of the invention.

FIG. 1 illustrates a heatable roller as used, e.g., in a laminating device of a color proofing system, with one half the roller shown in sectional view, FIG. 2 is a view of the contact spring ring used as an electrode for contacting the heating layer of the roller of FIG. 1, FIG. 3 is a partially sectional view of a second embodiment of a heater roller, and FIG. 4 is a partially sectional view of a third embodiment of a heater roller.

FIG. 1 shows, in semisectional view, a heated roller 10 with an electrically resistive heating layer 14 arranged on the periphery of heated roller 10. A heated roller of this type is used, e.g., in a laminating device of a color proofing system. Such heated rollers are also suited for use in heat fixing stations of copying machines to fix the toner image onto the copying paper. The heated roller is useful also in a number of other applications for heat treatment.

The heated roller 10 shown in FIG. 1 is provided with a support tube 16 formed as a hollow cylinder and made, e.g., from steel or another preferably metallic material. On both of its end sides, support tube 16 is provided with fixing rings 18 made, e.g., from an epoxy resin. Fixing rings 18 are substantially formed as a circular cap having an upright axial edge. This cap has a concentric central opening formed therein so that only a continuous edge portion, projecting at a right angle, is left of the cap. Fixing rings 18 are mounted on the axial ends of support tube 16 while concentrically surrounding these ends. On the axial ends, support tube 16 is formed with conically tapering portions so that the axial ends of support tube 16 have a smaller outer diameter than the rest of support tube 16. The resistive heating layer 14, made from a ceramic material and having a suitable surface resistance for using this material as a heating element, covers the whole peripheral surface of support tube 16. A respective spring ring 22 of a material having good electric conductivity is arranged between the fixing rings 18 and the axial ends of support tube 16. A spring ring 22 of this type is shown in FIG. 2 which will be explained later on. The fixing rings 18 for fixing the spring rings 22 between the upright edges of the fixing rings 18 and the axial ends of the support tube 16 are held by protective caps 24 having axes 26 received therein. The two caps 24 are connected to each other by tensioning screws 28 which extend in axial direction through the hollow cylindrical support tube 16. By its mutually aligned axes 26, heated roller 10 is rotatably supported on a suitable structure, e.g., the housing of a laminating device of a color proofing system. One of the two axes 26 is hollow. The electrical conductors 30, connecting the spring rings 22 to an electric energy supply means, extend through this hollow axis 26.

Figure 1A:
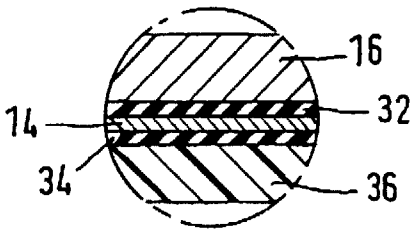
FIG. 1A is an enlarged view of a resistive heating layer of the heated roller of FIG. 1.

Referring to FIG. 1A, a heat insulating layer 32, which is made, e.g., from a non-conductive ceramic material, is arranged between the outer face of support tube 16 and the resistive heating layer 14. This layer 32 has the electrically resistive heating layer 14 applied thereon, with the peripheral outer face of resistive heating layer 14 in turn carrying a further electrically insulating layer 34 made, e.g., from a ceramic material. On layer 34, in turn, there is provided a thicker layer 36 of an elastic material such as a rubber material. This layer 36, forming the outer face of heated roller 10, has a temperature sensor 38 and an electric safety fuse 40 embedded therein. For reasons of clarity, the electrical connection between these two elements is not shown in FIG. 1.

As shown in FIG. 1 in a manner not true to scale, the thickness of the electrically resistive heating layer 14 is varying. The central region 42 of resistive heating layer 14 is thicker than the two edge regions 44 of heated roller 10 which extend from central region 42 to the axial ends of support tube 16. Because of the thinner shape of resistive heating layer 14 in the edge regions 44, these thinner regions of resistive heating layer 14 will be heated more intensively than the central region 42. Since the heat dissipation at the axial ends of heated roller 10 is more rapid than in the central region 42, this configuration provides for a uniform distribution of the surface temperature.

As already mentioned, the spring rings 22 are in contact with the electrically resistive heating layer 14 because they are pressed against the resistive heating layer 14 by the fixing rings 18. Thus, spring rings 22 act as electrodes for supply of electric potential, and for infeeding electrical current into resistive heating layer 14. Such a spring ring 22 is shown in FIG. 2. Spring ring 22 is made from a metallic material of good electric conductivity and is substantially provided as a spiral tension spring 45, its two ends being connected to each other at 46. As shown in FIG. 2, spring ring 22 is divided into three spring portions 48, which, however, is not imperative; spring ring 22 can also be provided as a continuous helical line. On a plurality of locations (three locations in the example shown in FIG. 2), electrical supply conductors 30, e.g., wires, are connected to spring ring 22 to obtain a substantially uniform supply of electric energy over the whole peripheral extension of spring ring 22. In the non-tensioned relieved condition of spring ring 22, its inner diameter is smaller than the outer diameter of the axial ends of support tube 16. Therefore, spring ring 22 has to be tensioned for being placed onto the axial ends of support tube 16. Because of the restoring force generated when spring ring 22 is tensioned, spring ring 22 exerts a radially inward pressure force on support tube 16 and thus on resistive heating layer 14, thus safeguarding a mechanically reliable contact between spring ring 22 and resistive heating layer 14.

With each turn of the helical spring ring 22, one contact point between spring ring 22 and resistive heating layer 14 is generated in the above manner. These contact points are equally distributed over resistive heating layer 14 in the circumferential direction. By providing the helical spring of spring ring 22 with suitably closely distanced windings, a plurality of closely adjacent contact points are obtained between spring ring 22 and resistive heating layer 14.

By using a spring ring 22 which, as explained above and shown in the Figures, consists of an annular spiral spring 45, there is obtained an electrode for the electrically resistive heating layer of heated roller 10 which is very simple in construction and reliable in operation. With this type of electrode, no other chemical or mechanical contact between the electrode and the heating resistance layer is required. This allows for a simple construction and a simple assembly procedure for the heated roller because mere standard components (spiral spring 45) will be sufficient, acting as electrodes in a simple manner.

FIG. 3 shows a second embodiment of a heated roller 50. In so far as the components of this heated roller 50 correspond to those of heated roller 10 according to FIGS. 1 and 2, identical reference numerals are used. In heated roller 50 of FIG. 3, each of the fixing rings 52 arranged on the axial ends of the support tube 16 is provided as a radially outward continuous flange, of which the axial portion engages support tube 16 on the inside thereof. In the peripheral surface of support tube 16, there is formed a peripheral groove 54 extending over 360'. Also in this region of peripheral groove 54, the outer surface of roller 16 is covered by the material of the electrically resistive heating layer. The spring ring 22 is arranged in peripheral groove 54. Peripheral groove 54 is closed by a rubberized outer layer 36 surrounding the whole support tube 16 from the outside. Otherwise, heated roller 50 has the same features as heated roller 10 shown in FIG. 1.

FIG. 4 shows a third embodiment of a heated roller 60. Again, the components of heated roller 60 corresponding to heated roller 10 of FIG. 1 have the same reference numerals as in FIG. 1. The fixing rings 62 used in heated roller 60 are provided with a continuous receiving groove 64 which is open in the axial direction of heated roller 60. In the assembled condition of heated roller 60, the axial ends of support tube 16 are received in the receiving grooves 64 of fixing rings 62 as shown in FIG. 4. Receiving groove 64 is formed by two legs 66, 68 of fixing ring 62, with the outer leg 66 having a larger axial dimension than the inner leg 68. In the portion of outer leg 66 projecting beyond inner leg 68, outer leg 66 and support tube 16 are exemplified as having the spring ring 22 arranged therebetween, spring ring 22 being kept pressed against the outer face of support tube 16 provided with the resistive heating layer 14. As in the embodiment according to FIG. 1, the spring rings 22 engage the resistive heating layer 14 of support tube 16 in the region of the conically tapering portions 20 of support tube 16. The embodiment of the inventive heated roller according to FIG. 4 is particularly easily assembled.

I claim:

1. A heating element comprising:

a support tube having a peripheral surface, wherein the support tube tapers conically toward an axial end;

an electrically resistive heating layer covering the peripheral surface of the support tube;

an elastic electrode having a contacting side comprising a plurality of projections for engaging the heating layer and uniformly applying a voltage to the heating layer;

a fixing ring coupled to the axial end of the support tube so as to form a groove for receiving the elastic electrode; and at least one supply conductor for supplying electrical energy to the elastic electrode.

2. The heating element of claim 1 wherein the elastic electrode is formed into a ring having an inner diameter smaller than an outer diameter of the support tube and wherein the elastic electrode can be placed around the support tube so as to exert a radially inward force on the support tube such that the contacting side engages the resistive heating layer.

3. The heating element of claim 2 wherein the at least one supply conductor is a plurality of supply conductors connected to the elastic electrode so as to uniformly supply electrical energy over a circumference of the elastic electrode.

4. The heating element of claim 1 wherein the elastic electrode comprises at least one spiral tension spring formed into a closed ring which is elastic in a circumferential direction and wherein the elastic electrode can be placed around the support tube so as to exert a radially inward force on the support tube such that the contacting side engages the resistive heating layer.

5. The heating element of claim 4 wherein the at least one supply conductor is a plurality of supply conductors connected to the elastic electrode so as to uniformly supply electrical energy over a circumference of the elastic electrode.

6. The heating element of claim 1 wherein the elastic electrode is a formed as a band having protrusions.

7. The heating element according to claim 1 wherein the heating layer comprises a central region and two end regions, and wherein the end regions are thinner than the central region and wherein the end regions are heated more intensively than the central region, thereby uniformly distributing a surface temperature of the heating layer.

8. The heating element according to claim 1 further comprising:

a first insulating layer disposed between the support tube and the heating layer, and an outer layer of silicone rubber covering the heating layer.

9. The heating element according to claim 8 further comprising a second insulating layer disposed between the heating layer and the outer layer of silicone rubber.

10. The heating element according to claim 9 wherein the first insulating layer, the second insulating layer and the heating layer comprise ceramic material.

* * * * *